US009920436B2

(12) United States Patent
Ko et al.

(10) Patent No.: US 9,920,436 B2
(45) Date of Patent: Mar. 20, 2018

(54) METHOD FOR SURFACE TREATMENT OF METALS USING BACTERIA

(71) Applicant: INDUSTRY-ACADEMIC COOPERATION FOUNDATION, YEUNGNAM UNIVERSITY, Gyeongsan-si, Gyeongsangbuk-do (KR)

(72) Inventors: Tae Jo Ko, Daegu (KR); Min Yeop Kim, Daegu (KR); Agung Shamsuddin Saragih, Daegu (KR)

(73) Assignee: INDUSTRY-ACADEMIC COOPERATION FOUNDATION, YEUNGNAM UNIVERSITY, Gyeongsan-si, Gyeongsangbuk-Do (KR)

( * ) Notice: Subject to any disclaimer, the term of this patent is extended or adjusted under 35 U.S.C. 154(b) by 0 days.

(21) Appl. No.: 15/255,872

(22) Filed: Sep. 2, 2016

(65) Prior Publication Data

US 2017/0152603 A1 Jun. 1, 2017

(30) Foreign Application Priority Data

Nov. 30, 2015 (KR) ..... 10-2015-0169377

(51) Int. Cl.

| | |
|---|---|
| ***C23F 1/16*** | (2006.01) |
| ***C23F 4/00*** | (2006.01) |
| ***C23G 1/10*** | (2006.01) |
| ***C23G 1/08*** | (2006.01) |

(52) U.S. Cl.

CPC ..... *C23G 1/103* (2013.01); *C23G 1/081* (2013.01)

(58) Field of Classification Search

None

See application file for complete search history.

(56) References Cited

U.S. PATENT DOCUMENTS

| | | | | |
|---|---|---|---|---|
| 2007/0066503 | A1* | 3/2007 | Basaly | C11D 3/042 510/238 |
| 2009/0241734 | A1* | 10/2009 | Imagawa | C22B 3/18 75/743 |
| 2016/0138128 | A1* | 5/2016 | Nicolay | C22B 3/18 435/262 |
| 2017/0058377 | A1* | 3/2017 | Bobadilla Fazzini | C22B 1/11 |

FOREIGN PATENT DOCUMENTS

| | | | |
|---|---|---|---|
| JP | 3223034 | * | 8/2001 |

* cited by examiner

*Primary Examiner* — Shamim Ahmed

(74) *Attorney, Agent, or Firm* — Hauptman Ham, LLP

(57) ABSTRACT

Provided is a method for surface-treatment of a metal using bacteria, and more particularly, a method for surface-treatment of a metal using bacteria including immersing the metal having a surface layer on which a deformed layer is formed in a culture fluid cultured with metal-oxidizing bacteria, such that the metal-oxidizing bacteria selectively oxidize and leach-remove the deformed layer of the metal to perform micro-machining, thereby minimizing a damage to a metal basic material to effectively remove the deformed layer of the metal, and further including partly coating a surface of the metal to produce fine patterns of which sizes and shapes are various.

6 Claims, 4 Drawing Sheets

METHOD FOR SURFACE TREATMENT OF METALS USING BACTERIA

CROSS-REFERENCE TO RELATED APPLICATIONS

This application claims priority under 35 U.S.C. § 119 to Korean Patent Application No. 10-2015-0169377, filed on Nov. 30, 2015, in the Korean Intellectual Property Office, the disclosure of which is incorporated herein by reference in its entirety.

TECHNICAL FIELD

The following disclosure relates to a method for surface-treatment of a metal using bacteria. More particularly, the following disclosure relates to a method for surface-treatment of a metal using bacteria that includes immersing the metal in a culture fluid cultured with metal-oxidizing bacteria, the metal having a surface layer on which a deformed layer is formed, such that the metal-oxidizing bacteria selectively oxidize and leach-remove the deformed layer of the metal to perform micro-machining, thereby minimizing damage to a metal basic material to effectively remove the deformed layer of the metal, and that further includes partly coating a surface of the metal to produce fine patterns of which sizes and shapes are various.

BACKGROUND

A deformed layer is formed on a surface of a metal mechanically machined through methods such as cutting, grinding, polishing, etc., as a result of the mechanical machining. The deformed layer formed on the metal surface is a metal oxide layer formed by heat generated at the time of cutting or grinding process, which is a finish surface layer having different characteristics from a metal basic material. The deformed layer causes plastic deformation, work hardening, work softening, residual stress, etc., having largely adverse effects on properties such as abrasion resistance, etc., of the metal, which deteriorates resistance to damage of the metal surface, and causes refinement of crystal grain, re-crystallization and crack, etc. Accordingly, a surface-treatment method for removing the deformed layer of the metal is necessarily required so as not to cause these problems.

The surface-treatment method for removing the deformed layer formed on a metal surface layer to minimize metal damage includes laser etching, etc. The laser etching is one of the methods generally used in technology for implementing fine patterns on the metal surface, which has been actively used since the metal surface is capable of being finely processed by irradiating a laser beam to the metal, thereby finely removing the deformed layer which is thinly formed on the metal surface.

However, since a pulse intensity of the laser beam irradiated by the laser etching is excessively high, the metal basic material as well as the deformed layer of the metal surface layer are affected by the laser beam and heat caused by the beam, such that the metal is damaged, and the deformed layer is formed again on the surface of damaged metal basic material, etc., which causes a problem in that efficiency is reduced in the removing process of the deformed layer of the metal. Therefore, it is demanded to develop a method for effectively removing the deformed layer on the metal surface capable of solving these problems.

SUMMARY

An embodiment of the present invention is directed to providing a method for surface-treatment of a metal using bacteria capable of minimizing damage to a metal basic material due to heat and a possibility in which a metal deformed layer is additionally produced, and effectively removing the deformed layer by adding the metal in a culture fluid cultured with metal-oxidizing bacteria for a specific time, the metal having a surface layer on which the deformed layer is formed by mechanical machining, such that the metal-oxidizing bacteria selectively oxidize and leach-remove the deformed layer of the metal.

Another embodiment of the present invention is directed to providing a method for surface-treatment of a metal capable of forming fine patterns of which sizes and shapes are various on a metal surface by further including coating a part of the metal surface of which the deformed layer is formed in the method for surface-treatment.

In one general aspect, there is provided a method for surface-treatment of a metal using bacteria including: immersing a metal having a surface layer on which a deformed layer is formed in a bacterial culture fluid containing metal-oxidizing bacteria and a liquid medium of pH 2 to 3.5, such that the metal-oxidizing bacteria selectively remove the deformed layer of the metal.

The metal may be any one or two or more of metals selected from iron, copper, zinc, and nickel, etc.

The metal-oxidizing bacteria may be any one or more bacteria selected from *Acidithiobacillus* species, *Leptospirillum* species, *Sulfobacillus* species, *Acidiphilium* species, and *Thermosulfidooxidans* species, etc.

The liquid medium used at the time of preparing the bacterial culture fluid may include any one or two or more selected from alkali metal salts and alkaline earth metal salts.

An acidity of the liquid medium may be controlled by adding sulfuric acid.

The method may further include: before the immersing of the metal having the deformed layer formed thereon in the bacterial culture fluid, coating process of a surface part which is not subjected to the surface-treatment.

The immersing of the metal having the deformed layer formed thereon may be performed for 12 to 48 hours.

DETAILED DESCRIPTION OF EMBODIMENTS

Figure 1:
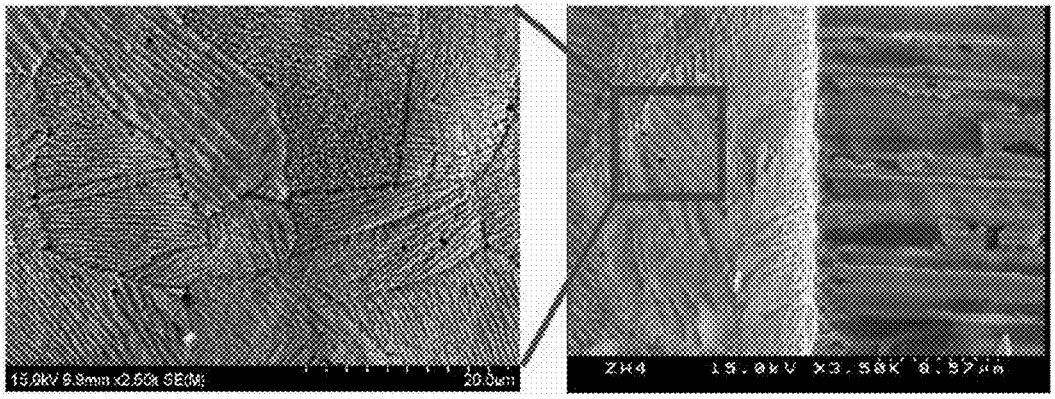
FIG. 1 illustrates surface roughness of surface-treated copper by Example 1 of the present invention, and specifically, surfaces of copper from which deformed layers are removed through surface-treatment (see left drawing and left side of the right drawing), and a surface of copper including the deformed layer on a surface layer since it is not subjected to surface-treatment (see right side of the right drawing).

Hereinafter, a method for surface-treatment of a metal using bacteria according to the present invention is described in detail. The exemplary embodiments to be described below and the accompanying drawings are provided by way of example so as to sufficiently transfer technical spirit of the present invention to a person of ordinary skill in the art, and accordingly, the technical scope of the present invention is not limited or changed, and a variety of different changes and modifications can be made on the basis of these exemplary embodiments within the scope of the technical spirit of the present invention. In addition, unless technical and scientific terms used herein are defined otherwise, they have meanings generally understood by those skilled in the art to which the present invention pertains. Known functions and components that may obscure the gist of the present invention with unnecessary detail will be omitted.

The term "a deformed layer" used herein means a metal oxide layer formed on a surface of a metal by heat caused at the time of cutting, grinding, etc., of the metal, and is described as a word indicating non-uniform metal oxide damaged layer having different characteristics from a metal basic material.

The present invention relates to a method for surface-treatment of a metal using bacteria, and a method for surface-treatment of a metal using bacteria including immersing a metal having a deformed layer formed thereon in a bacterial culture fluid containing metal-oxidizing bacteria and a liquid medium of pH 2 to 3.5, such that the metal-oxidizing bacteria selectively remove the deformed layer of the metal.

Here, the metal used in the present invention is a metal having a surface layer on which the deformed layer is formed, and the metal-oxidizing bacteria are bacteria capable of oxidizing a metal in a solid state into metal ions. The present invention is characterized that the metal-oxidizing bacteria selectively oxidize the deformed layer of the surface layer of the metal to convert the metal of the deformed layer into an ionic state of metal, such that the deformed layer is selectively removed from a metal basic material.

The metal used in the present invention may include any one or two or more of metals selected from iron, copper, zinc, nickel, etc., but is not specifically limited thereto, and may include the deformed layer on the surface layer as described above.

In addition, the metal-oxidizing bacteria used to remove the deformed layer of the metal in the present invention are oxidizing bacteria capable of oxidizing the metal of the present invention under aerobic condition, and specifically may include any one or more bacteria selected from *Acidithiobacillus* species, *Leptospirillum* species, *Sulfobacillus* species, *Acidiphilium* species and *Thermosulfidooxidans* species, etc., and more specifically, any one or more bacteria selected from *Acidithiobacillus ferooxidans, Leptospirillum ferooxidans, Acidithiobacillus thiooxidans, Acidithiobacillus caldus* and *Sulfobacillus thermosulfidooxidans*, etc.

In the method for surface-treatment of the metal according to the present invention, the bacterial culture fluid may be prepared by culturing metal-oxidizing bacteria of the present invention in a liquid medium, wherein the bacterial culture fluid may include the metal-oxidizing bacteria having an appropriate number of cells which is appropriate to remove the metal deformed layer of the present invention through oxidation. The liquid medium used for preparing the bacterial culture fluid in the present invention is used to maintain growth and activity of the metal-oxidizing bacteria, and may be any medium known in the art, and may also include general nutrients known in the art.

The liquid medium used for culturing the metal-oxidizing bacteria in the present invention may preferably include electron donors for transferring electrons required in a respiratory process of the bacteria. Here, the electron donor may be any material capable of transferring the electrons to induce reduction, and may preferably include any one or two or more selected from alkali metal salts and alkaline earth metal salts, etc., but is not specifically limited thereto.

Further, the liquid medium may further include any one or two or more of compounds selected from phosphorus compounds and fluorine compounds.

The phosphorus compound used in the present invention may include phosphorus-containing compounds such as phosphoric acids, phosphate esters, organic phosphonic acids, etc. More specifically, the phosphoric acids may include condensed phosphoric acid including phosphoric acid (orthophosphoric acid), tri-metaphosphoric acid, tetra metaphosphoric acid, hexa metaphosphoric acid, pyrophosphoric acid, tripolyphosphoric acid, tetrapolyphosphoric acid, etc., and salts thereof (ammonium salts, sodium salts, potassium salts, magnesium salts, lithium salts, etc.), the phosphate esters may include trimethyl phosphate, triethyl phosphate, tributyl phosphate, monomethyl phosphate, dimethyl phosphate, ethyl phosphate, diethyl phosphate, monobutyl phosphate, dibutyl phosphate, phytic acid and salts thereof (ammonium salts, sodium salts, potassium salts, magnesium salts, lithium salts, etc.), riboflavin phosphate ester, etc. Further, the organic phosphonic acids may include amino trimethylene phosphonic acid, 1-hydroxyethylidene 1,1-diphosphonic acid, ethylenediamine tetramethylene phosphonic acid, diethylenetriamine pentamethylene phosphonic acid, etc. The phosphorus compound used in the present invention may be preferably any one or two or more selected from sodium salts, potassium salts, ammonium salts, magnesium salts and lithium salts of phosphoric acid, pyrophosphoric acid, tripolyphosphoric acid, tetrapolyphosphoric acid, phytic acid, and organic phosphonic acid, but is not specifically limited thereto.

In addition, the fluorine compound used in the present invention may include fluorine-containing compounds such as hydrofluoric acid, hydrofluosilicic acid, sodium fluoride, potassium fluoride, ammonium fluoride, lithium fluoride, acidic sodium fluoride, acidic potassium fluoride, acidic ammonium fluoride, fluorozirconium acid, fluorozirconium acid ammonium, fluoro-titanic acid, and fluoro-titanic acid ammonium, etc. The fluorine compound used in the present invention may be preferably any one or two or more selected from sodium salts, potassium salts, ammonium salts, and lithium salts of hydrofluoric acid, but is not specifically limited thereto.

Any one or two or more of compounds selected from the phosphorus compounds and the fluorine compounds in the present invention may have a concentration of 0.3 to 1.5 mg/ml, preferably, 0.6 to 1.4 mg/ml, and more preferably, 1.0 to 1.3 mg/ml, in the liquid medium. When the above-described concentration of phosphorus compounds and fluorine compounds are included in the liquid medium in the present invention, the metal deformed layer of the present invention immersed in the liquid medium may be selectively etched by the compound, such that the removing reaction of the deformed layer is more rapidly performed as compared to a case only using the metal-oxidizing bacteria of the present invention. Further, the phosphorus compounds and the fluorine compounds are chemically adsorbed on the surface part of the metal basic material formed by removing the deformed layer through the present invention, such that permeability of negative ions which are factor causing metal corrosion is reduced, such that corrosion resistance of the metal from which the deformed layer is removed is improved.

In addition, the liquid medium of the present invention may have acidity of pH 2 to 3.5. The metal-oxidizing bacteria of the present invention may have bacterial activity in an appropriate range when cultured in media having the above-described acidity, and accordingly, it is preferred that an oxidization reaction of the metal is generated at an appropriate speed, such that the deformed layer of the metal surface layer is effectively leach-removed within a range at which the metal basic material is not damaged.

The liquid medium of the present invention may control and maintain the above-described acidity by adding acid, and preferably, may maintain the above-described acidity by adding sulfuric acid. A kind of acid added to maintain the acidity range of the liquid medium in the present invention is not specifically limited thereto. However, by adding sulfuric acid, growth and culturing speed of the metal-oxidizing bacteria used in the present invention are improved, and at the same time, activity of the metal-oxidizing bacteria is maximized, which is the most preferred since the activated metal-oxidizing bacterial culture fluid having an appropriate concentration required in the present invention is capable of being prepared in a short period of time.

The culturing of bacterial for preparing the metal-oxidizing bacterial culture fluid used in the present invention is not specifically limited in view of condition for performing the culturing. In addition, the bacterial culture fluid of the present invention prepared by the culturing step of bacteria may include the metal-oxidizing bacteria at a concentration of $1\times10^6$ active cell/ml or more, preferably, $8.0\times10^6$ to $1\times10^9$ active cell/ml, but the bacterial concentration in the bacterial culture fluid is not specifically limited thereto as long as the effect of the present invention in which the deformed layer of the metal is selectively oxidized and leach-removed is shown.

The method for surface-treatment of a metal according to the present invention may include the immersing step of the metal in the bacterial culture fluid, such that the metal having the surface layer on which the deformed layer is formed is in contact with the metal-oxidizing bacteria in the culture fluid so that the metal-oxidizing bacteria oxidize the deformed layer of the metal surface layer. Accordingly, the deformed layer of the metal is converted into an ionic state of metal to be leached in the culture fluid, such that the deformed layer formed on the metal surface layer is selectively removed from the metal basic material.

The metal having the deformed layer formed thereon to be immersed in the bacterial culture fluid may be further subjected to a process of coating a surface part which is not subjected to the surface-treatment in the metal deformed layer(hereinafter, a coating step), before the immersing step of the metal in the bacterial culture fluid. The coating in the above step may be performed by general metal surface pattern-forming technology processes such as lithography, maskless lithography, etc., and through the coating step, a metal on which a coating film consisting of materials such as a polymer, etc., that is not oxidized by the metal-oxidizing bacteria of the present invention is formed may be prepared on the deformed layer of remaining parts except for parts that are intended to form etching patterns. The metal after which the coating step is performed is immersed in the bacterial culture fluid, such that the remaining deformed layer except for a coating film part of the metal is selectively leach-removed, such that the etching patterns of which sizes and shapes are various may be formed on the surface.

In the method for surface-treatment of the metal according to the present invention, the immersing step of the metal having the deformed layer formed thereon may be performed for 5 hours or more, and preferably, 12 to 48 hours, so that a reaction between the metal-oxidizing bacteria of the present invention and the deformed layer of the metal is sufficiently generated. A temperature of the bacterial culture fluid used in the immersing step of the metal in the present invention may be 20 to 40° C., but is not specifically limited thereto. Time for immersing the metal is not specifically limited to the above-described time range, but when the above-described time range is satisfied, it is preferred since sufficient contact between the deformed layer of the metal and the metal-oxidizing bacteria of the present invention may be achieved, and the metal from which the deformed layer of the surface layer is maximally removed may be effectively obtained.

In addition, when a metal in which a coating film is formed on a part of the surface through the coating step is used as a metal immersed in the bacterial culture fluid in the present invention, the deformed layer on which the coating film is not formed may be selectively leach-removed, such that etching patterns may be formed on the metal surface. Here, the etching patterns of which sizes (widths) and depths are various are formed on the metal surface depending on time for immersing the metal in the culture fluid, such that the size and the depth of the etching patterns formed on the surface may be controlled by controlling the time for immersing the metal, and it is possible to form complicated and fine patterns which are difficult to be implemented by known technologies for forming metal surface patterns that form etching patterns on the surface by causing a large amount of energy and heat.

The metal containing the deformed layer of the present invention may be immersed in the bacterial culture fluid for a specific period of time, and may be separated from the culture fluid, followed by washing and drying processes, such that a metal from which the deformed layer is removed or a metal having a surface on which the etching patterns are formed may be recovered.

Hereinafter, preferred embodiments of the present invention will be described to assist in understanding the present invention. However, the following Examples are provided by way of example only so that a person skilled in the art can more easily understand the disclosures of the present invention. Therefore, the present invention is not limited to the following Examples, but may be variously modified and changed.

Therefore, the spirit of the present invention should not be limited to the above-described exemplary embodiments, and the claims to be described below as well as all modified equally or equivalently to the claims are intended to fall within the scopes and spirit of the present invention.

First, an experimental method practiced in the present invention is described below.

Experiment 1) observation of surface roughness, surface shape and cross-section of metal Surface roughness, surface shapes and cross-sections of metals surface-treated by Examples below were observed by using SEM (scanning electron microscope).

EXAMPLE 1

<Preparation of Bacterial Culture Fluid>

A mixed solution was prepared by adding 6 g of ammonium sulfate ($(NH_4)_2SO_4$), 1 g of dipotassium phosphate ($K_2HPO_4$), 1 g of magnesium sulfate ($MgSO_4$), 0.2 g of potassium chloride (KCl), and 0.02 g of calcium nitrate ($Ca(NO_3)_2$) to 1400 ml of water, and sulfuric acid ($H_2SO_4$) was added to the mixed solution to prepare a liquid medium in which acidity is pH 2.5.

*Acidithiobacillus ferooxidans* and *Acidithiobacillus thiooxidans* each having a small amount as the metal-oxidizing bacteria were added to the liquid medium, and the medium was cultured in a bacterial incubator having a constant temperature condition of 26° C., thereby preparing a bacterial culture fluid in which a density of the bacteria is $2.6\times10^7$ active cell/ml.

<Surface-Treatment of Metal (Removal of Deformed Layer)>

A copper block having a surface on which a deformed layer is formed and having a size of 12 mm×12 mm×10 mm was formed by polishing copper basic material with 1000 grit polishing disc. A half of the copper block was immersed in the prepared bacterial culture fluid for 48 hours, separated from the culture fluid, washed with water, and dried to obtain the copper block from which the deformed layer is removed.

EXAMPLE 2

A Iron block from which a deformed layer is removed was obtained by the same method as Example 1 above except for using iron having a surface on which a deformed layer is formed and having a cylindrical shape of which a diameter is 22 mm and a height is 10 mm by polishing iron basic material with 1000 grit polishing disc, instead of using the copper block in Example 1.

EXAMPLE 3

A copper block from which a deformed layer is removed was obtained by the same method as Example 1 above except for using a copper block in which a photoresist film is formed on the deformed layer of remaining parts except for parts that are intended to form etching patterns through lithography process, instead of using the copper block in Example 1.

EXAMPLE 4

A copper block from which a deformed layer is removed was obtained by the same method as Example 3 above except for preparing a liquid medium by further adding 0.5 g of sodium hydrogen fluoride ($NaHF_2$) in the preparation step of the bacterial culture fluid of Example 3.

COMPARATIVE EXAMPLE 1

A copper block from which a deformed layer is removed was obtained by the same method as Example 3 above except for using a liquid medium of pH 4, instead of using the liquid medium of pH 2.5 in Example 3.

Figure 2:
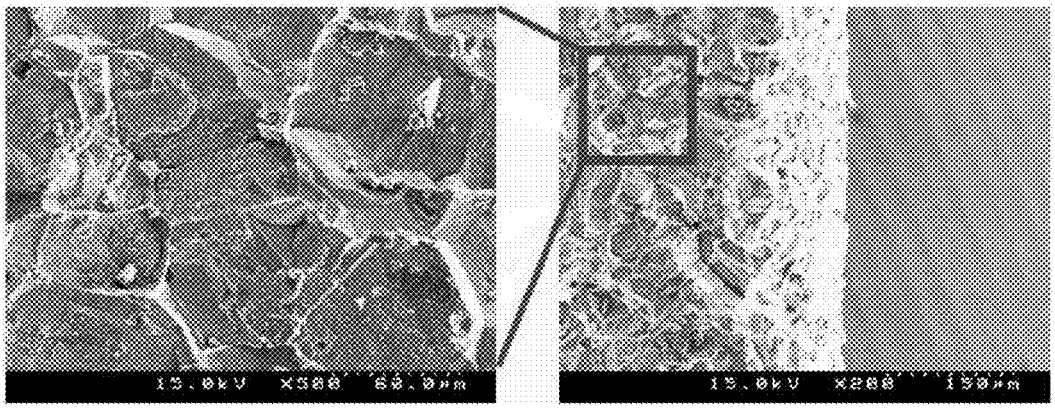
FIG. 2 illustrates surface roughness of surface-treated iron by Example 2 of the present invention, and specifically, surfaces of iron from which deformed layers are removed through surface-treatment (see left drawing and left side of the right drawing), and a surface of iron including the deformed layer on a surface layer since it is not subjected to surface-treatment (see right side of the right drawing).
Figure 7:
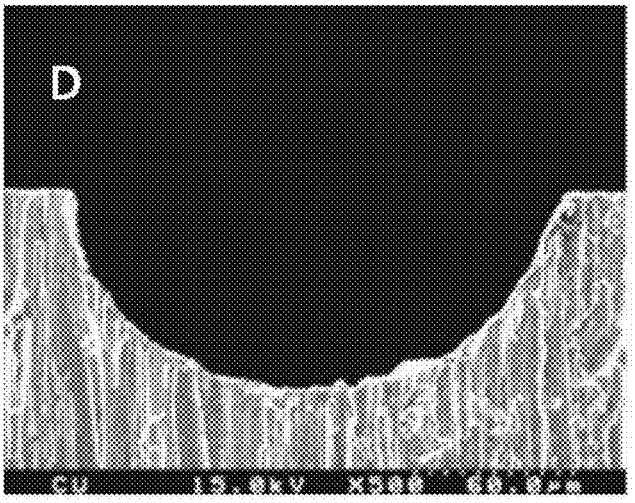
FIG. 7 illustrates cross-sections of copper on which etching patterns are formed through surface-treatment according to Example 3 of the present invention, and specifically, a cross-section of a part of etching patterns formed by the surface-treatment for 48 hours.

Surface roughness of the metals from which the deformed layers are removed according to Examples 1 and 2 above was observed through the method of Experiment 1) above, and results thereof were illustrated in FIGS. 1 and 2. In addition, surface shapes and cross-sections of the metal from which the deformed layer is removed according to Example 3 were observed through the method of Experiment 1) above, and results thereof were illustrated in FIGS. 3 and 7.

It could be confirmed from FIGS. 1 and 2 illustrating the results of Examples 1 and 2 that as compared to the left sides of the metals which were not subjected to the surface-treatment to have a surface layer on which the deformed layer is present, thereby having high surface roughness, the right sides of the surface-treated metal according to the present invention had low surface roughness, such that the deformed layer present on the surface layer of the metal could be effectively removed through the method for surface-treatment using the metal-oxidizing bacteria according to the present invention.

Figure 3:
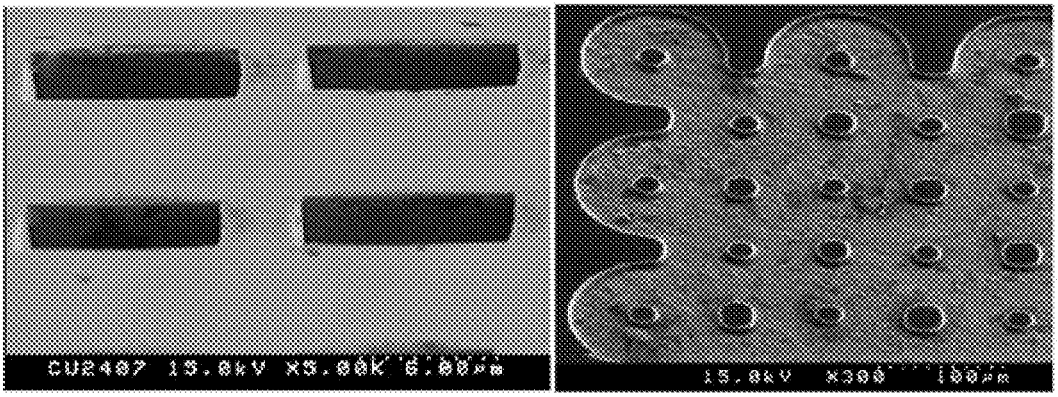
FIG. 3 illustrates two copper surface shapes formed with different etching patterns by removing the deformed layers according to Example 3 of the present invention.
Figure 4:
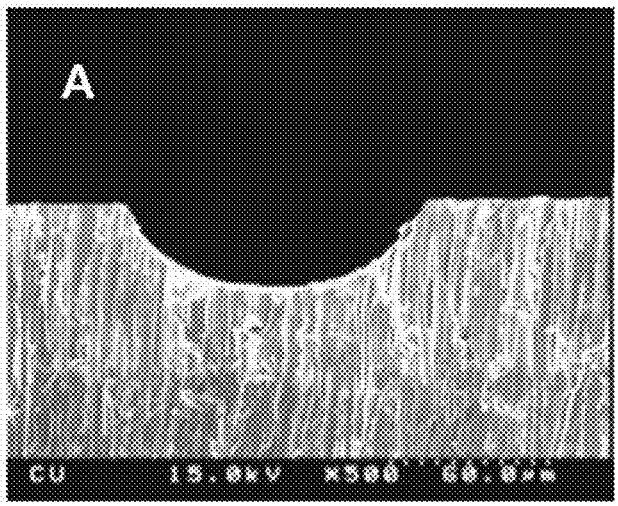
FIG. 4 illustrates cross-sections of copper on which etching patterns are formed through surface-treatment according to Example 3 of the present invention, and specifically, a cross-section of a part of etching patterns formed by the surface-treatment for 12 hours.
Figure 5:
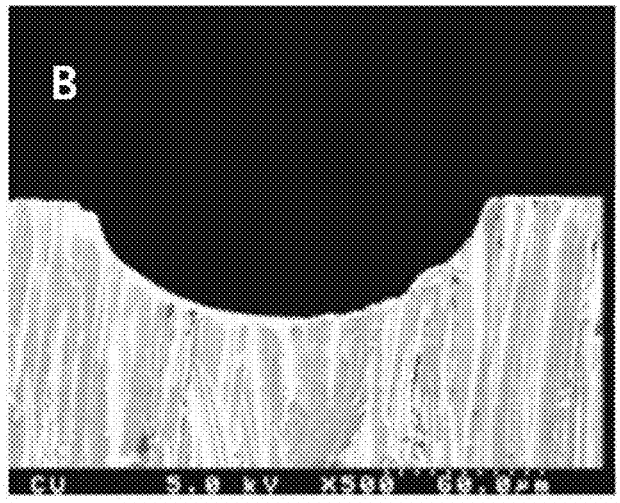
FIG. 5 illustrates cross-sections of copper on which etching patterns are formed through surface-treatment according to Example 3 of the present invention, and specifically, a cross-section of a part of etching patterns formed by the surface-treatment for 24 hours.
Figure 6:
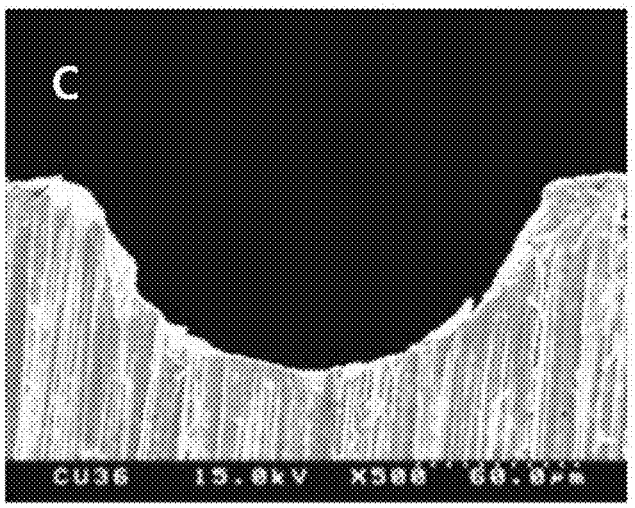
FIG. 6 illustrates cross-sections of copper on which etching patterns are formed through surface-treatment according to Example 3 of the present invention, and specifically, a cross-section of a part of etching patterns formed by the surface-treatment for 36 hours.

Further, it could be appreciated from FIG. 3 illustrating the result of Example 3 that fine patterns of which sizes and shapes are various could be formed on the surface of the metal through the method for surface-treatment according to the present invention, and it could be confirmed from FIG. 4 to FIG. 7 that as time for immersing the metal was longer, the size (the width) of the etching patterns formed on the surface of the metal was wider and a depth thereof was deeper. From the results above, it could be appreciated that the size and the depth of the patterns formed on the surface could be controlled by controlling time for immersing the metal. On the contrary, it was confirmed in the surface-treated copper by Comparative Example 1 that a reaction for removing the deformed layer of the metal was insignificantly generated even though the surface-treatment process was performed for 48 hours or more, such that the etching patterns were hardly formed.

In addition, when the copper block was immersed in bacterial culture fluid of Example 4 for 28 hours, patterns having the same depth and the same size as those of patterns capable of being obtained when the copper block was immersed in the bacterial culture fluid of Example 3 for 36 hours could be formed, and it could be appreciated from the above-result that as the contents of the phosphorus compound and the fluorine compound added in the liquid medium are increased by a small amount, a speed of the reaction for removing the deformed layer could be effectively improved. Further, as a result of immersing the surface-treated copper blocks in water for 10 hours, the surface-treated copper blocks obtained by equally performing the immersing step of Examples 3 and 4 for 48 hours, a part of the copper basic material directly exposed to water was finely corroded in the copper block of Example 3, but the copper block of Example 4 did not have corrosion even in any part of the copper basic material exposed to water. Therefore, it was confirmed that when the contents of the phosphorus compound and the fluorine compound included in the liquid medium of the bacterial culture fluid satisfy the scope of the present invention, corrosion resistance of the metal could be effectively improved.

The method for surface-treatment of a metal using bacteria according to the present invention is a method for surface-treatment of a metal that selectively removes the deformed layer formed on the surface layer of the metal through mechanical machining by using bacteria (metal-oxidizing bacteria) capable of oxidizing the metal and controlling time for performing the surface-treatment. The method for surface-treatment of the present invention may not cause heat at the time of the surface-treatment of the metal which is unlike the existing methods according to the related art, thereby minimizing damage of the metal basic material due to heat and thus additional occurrence of the deformed layer (the metal oxide layer) on the metal surface layer, such that efficiency for removing the deformed layer may be improved. In addition, the method for surface-treatment of a metal of the present invention further includes, before performing the surface-treatment, the step of partly coating the surface of the metal on which the deformed layer is formed, such that fine patterns of which sizes and shapes are various may be precisely formed on the metal surface without performing separate processes for forming fine patterns. Therefore, the method for surface-treatment of the metal of the present invention may be applied even to technology for forming fine patterns of the metal.

What is claimed is:

1. A method for surface-treatment of a metal using bacteria comprising:

immersing a metal having a deformed layer formed thereon in a bacterial culture fluid containing metal-oxidizing bacteria, alkali salts of hydrofluoric acid and a liquid medium of pH 2 to 3.5, such that the metal-oxidizing bacteria selectively remove the deformed layer of the metal.

2. The method of claim 1, wherein the metal includes any one or two or more of metals selected from iron, copper, zinc, and nickel.

3. The method of claim 1, wherein the metal-oxidizing bacteria include any one or more bacteria selected from *Acidithiobacillus* species, *Leptospirillum* species, *Sulfobacillus* species, *Acidiphilium* species and *Thermosulfidooxidans* species.

4. The method of claim 1, wherein an acidity of the liquid medium is controlled by adding sulfuric acid.

5. The method of claim 1, further comprising: before the immersing of the metal having the deformed layer formed thereon in the bacterial culture fluid, coating process of a surface part which is not subjected to the surface-treatment.

6. The method of claim 1, wherein the immersing of the metal having the deformed layer formed thereon is performed for 12 to 48 hours.

* * * * *